US010581162B2

(12) United States Patent
Nishimura

(10) Patent No.: US 10,581,162 B2
(45) Date of Patent: Mar. 3, 2020

(54) SYSTEMS AND METHODS FOR DETERMINING A SPATIAL RADIATION CHARACTERISTIC OF A TRANSMITTED RADIO-FREQUENCY SIGNAL

(71) Applicant: Keysight Technologies, Inc., Santa Rosa, CA (US)

(72) Inventor: Ken A Nishimura, Fremont, CA (US)

(73) Assignee: Keysight Technologies, Inc., Santa Rosa, CA (US)

( * ) Notice: Subject to any disclaimer, the term of this patent is extended or adjusted under 35 U.S.C. 154(b) by 724 days.

(21) Appl. No.: 15/243,425

(22) Filed: Aug. 22, 2016

(65) Prior Publication Data

US 2018/0053996 A1 Feb. 22, 2018

(51) Int. Cl.
*H01Q 3/26* (2006.01)
*H01Q 3/34* (2006.01)
*H01Q 15/16* (2006.01)

(52) U.S. Cl.
CPC ..... *H01Q 3/267* (2013.01); *H01Q 3/34* (2013.01); *H01Q 15/16* (2013.01)

(58) Field of Classification Search
CPC ..... H01Q 3/267; H01Q 2011/0083; H01Q 15/16; H04B 7/005; G01S 7/025; G01S 7/03; G01S 7/4052; G01S 2007/4069; G01S 2007/4095; G01S 13/88; G01S 17/87; G01S 7/4813; G01S 7/4863; G01S 7/41; Y02A 90/18
USPC ..... 342/6
See application file for complete search history.

(56) References Cited

U.S. PATENT DOCUMENTS 4,347,512 A * 8/1982 Sweeney ..... G01S 13/78 342/51
4,855,961 A * 8/1989 Jaffe ..... G01S 15/89 367/7
5,430,369 A 7/1995 Bolomey
(Continued)

FOREIGN PATENT DOCUMENTS

JP 2012124749 A * 6/2012 ..... H01Q 3/267

OTHER PUBLICATIONS

Weijun Yao et. al., A Self-Calibration Antenna Array System with Moving Apertures, 2003 IEEE MTS-S Digest, pp. 1541-1544.

*Primary Examiner* — Olumide Ajibade Akonai

(57) ABSTRACT

In an exemplary embodiment, an RF device includes a receiver and an antenna. The antenna is configured to receive a reflected radio-frequency signal containing a set of modulated signal segments. Each modulated signal segment has a unique modulation pattern that indicates a time-variant reflectivity characteristic of a respective signal reflecting tile of a radio-frequency signal reflector. The receiver can include a circuit to process the modulated signal segments and determine a spatial intensity distribution of the radio-frequency signal incident upon the radio-frequency signal reflector. The spatial intensity distribution can be used by the circuit to determine a spatial radiation characteristic of an RF signal that is transmitted by a transmitter in order to produce the reflected radio-frequency signal. The transmitter, which can be incorporated into the RF device, includes a beam steering circuit that can modify a spatial radiation characteristic of the transmitted RF signal for addressing a misalignment.

20 Claims, 6 Drawing Sheets

(56) References Cited

U.S. PATENT DOCUMENTS

| | | | | |
|---|---|---|---|---|
| 6,097,669 | A * | 8/2000 | Jordan | G01S 7/527 342/159 |
| 6,163,296 | A | 12/2000 | Lier | |
| 6,169,512 | B1 | 1/2001 | Beasley | |
| 6,965,340 | B1 * | 11/2005 | Baharav et al. | G01S 13/89 342/22 |
| 8,289,199 | B2 * | 10/2012 | Baharav et al. | G01S 13/89 342/6 |
| 2009/0061715 | A1 * | 3/2009 | Evans | H04B 7/0602 442/301 |
| 2009/0103593 | A1 | 4/2009 | Bergamo | |
| 2011/0102286 | A1 * | 5/2011 | Gualtieri | H01Q 7/00 343/817 |
| 2012/0027066 | A1 * | 2/2012 | O'Keeffe | H01Q 1/246 375/224 |
| 2012/0146841 | A1 * | 6/2012 | Ookawa | H01Q 3/267 342/174 |
| 2013/0093623 | A1 * | 4/2013 | Fujii | H04B 7/061 342/36 |
| 2014/0132450 | A1 * | 5/2014 | Chen | H01O 3/267 342/368 |

* cited by examiner

SYSTEMS AND METHODS FOR DETERMINING A SPATIAL RADIATION CHARACTERISTIC OF A TRANSMITTED RADIO-FREQUENCY SIGNAL

BACKGROUND

Communication systems often employ millimeter-wave radio-frequency (RF) signals for various reasons, including the narrow beam characteristic that can be achieved by such signals. Narrow beam characteristics provide for a focused beam that can be precisely directed towards a target antenna and a greater signal reach in a selected direction as a result of a higher gain (in comparison to an omnidirectional RF signal, for example).

Another reason for the use of millimeter-wave RF signals can be attributed to the reduced size of components used for operating on these signals. Such components, which can be readily packaged inside an integrated circuit (IC), can not only include circuit components associated with an RF transmitter, an RF receiver, a signal conditioner, and/or a signal processor, but can also include an RF antenna. Typically, the RF antenna is fabricated upon a substrate of the IC or is integrated into the package and cannot be moved around physically with respect to the package for purposes of orienting the RF antenna in a desired direction when transmitting a millimeter-wave RF. However, this problem can be addressed by using a beam-steering circuit to electronically steer the beam and provide a desired radiation characteristic to the transmitted millimeter-wave RF signal.

Typically, the beam-steering circuit incorporates one or more phase delay elements that are used to selectively change a relative phase characteristic of the millimeter-wave RF signal in order to perform beam steering. Unfortunately, the amount of phase delay provided by a first phase delay element fabricated inside a first IC among a batch of ICs can be different than the amount of phase delay provided by a similar phase delay element fabricated inside another similar IC among the batch of ICs. This can occur due to various factors such as component-to-component variations and manufacturing tolerances. The end result of having such differences, not just in the phase delay elements but in various other elements of RF ICs as well, can lead to an unacceptable level of mismatch in RF beam radiation characteristics from one RF IC to another.

This issue has been traditionally addressed by using testing and/or quality assurance (QA) procedures that require sophisticated test equipment and complex testing techniques. Understandably, many such traditional test procedures can turn out to be quite time consuming and expensive.

SUMMARY

Certain embodiments of the disclosure can provide a technical effect and/or solution to determine a spatial radiation characteristic of a radio-frequency (RF) signal transmitted by an RF transmitter. Towards this end, an RF signal is transmitted by the RF transmitter towards an RF signal reflector. At least a portion of the transmitted RF signal is reflected by a number of signal reflecting tiles of the RF signal reflector. The RF signal reflector is particularly configured to use a set of modulation code sequences to modulate a reflective property of each of the signal reflecting tiles in a uniquely identifiable time-variant pattern. Consequently, the portion of the RF signal that is reflected by the RF signal reflecting tiles contains a set of modulated signal segments, each modulated signal segment characterized in part by a uniquely identifiable time-variant pattern.

The reflected RF signal can be received in an RF receiver of a device and processed to not only identify each RF signal reflecting tile (using the uniquely identifiable time-variant patterns present in each modulated signal segment) but to also carry out signal intensity measurements upon the modulated signal segments. The identification of the RF signal reflecting tiles and the signal intensity measurements carried out upon the modulated signal segments are then used to determine a spatial intensity distribution of the transmitted RF signal when the transmitted RF signal hits the RF signal reflector. The spatial intensity distribution can be used for various purposes, including for the purpose of determining a spatial radiation characteristic of the RF signal transmitted by the RF transmitter.

According to one exemplary embodiment of the disclosure, a method can include various operations such as transmitting a first radio-frequency signal from a first radio-frequency device and receiving at least a portion of the first radio-frequency signal in a radio-frequency signal reflector. The radio-frequency signal reflector, which includes a plurality of signal reflecting tiles generates a set of modulated signal segments that are reflected back towards the first radio-frequency device and/or a second radio-frequency device. The generating is carried out by using a first modulation code sequence to modulate a reflectivity of a first signal reflecting tile in a first time-variant pattern and produce therefrom, a first modulated signal segment indicative of a first time-variant reflective characteristic, and by using a second modulation code sequence to modulate a reflectivity of a second signal reflecting tile in a second time-variant pattern and produce therefrom, a second modulated signal segment indicative of a second time-variant reflective characteristic. The method can further include operations such as receiving in the first radio-frequency device and/or the second radio-frequency device, the set of modulated signal segments; processing, in the first radio-frequency device and/or the second radio-frequency device, the set of modulated signal segments to determine a spatial intensity distribution of the first radio-frequency signal upon the radio-frequency signal reflector; and using the spatial intensity distribution to determine one or more spatial radiation characteristics of the first radio-frequency signal that is transmitted from the first radio-frequency device.

According to another exemplary embodiment of the disclosure, a method can include various operations such as receiving in a first radio-frequency device, a reflected radio-frequency signal containing a set of modulated signal segments. Each modulated signal segment is characterized by a respective modulation pattern that is unique to each modulated signal segment and is indicative of a time-variant reflectivity characteristic of each individual signal reflecting tile of a radio-frequency signal reflector having a plurality of signal reflecting tiles. The method can further include operations such as processing the set of modulated signal segments to identify a spatial intensity distribution of the radio-frequency signal upon the radio-frequency signal reflector, wherein processing the set of modulated signal segments can include identifying a first signal amplitude of the reflected radio-frequency signal by using a first code sequence to detect a correlation between the first code sequence and the set of modulated signal segments; identifying a second signal amplitude of the reflected radio-frequency signal by using a second code sequence to detect a correlation between the second code sequence and the set of modulated signal segments; and determining, based on the first signal amplitude and/or the second first signal amplitude, the spatial intensity distribution of the radio-frequency signal upon the radio-frequency signal reflector. The method can also include determining, based at least in part on the spatial intensity distribution, one or more radiation characteristics of a radio-frequency signal transmitted by the first radio-frequency device and/or a second radio-frequency device.

According to yet another exemplary embodiment of the disclosure, a radio-frequency device can include a first antenna and one or more receivers coupled to the first antenna. The first antenna is configured to receive a reflected radio-frequency signal containing a set of modulated signal segments, each modulated signal segment characterized by a respective modulation pattern that is unique to each modulated signal segment and is indicative of a time-variant reflectivity characteristic of each individual signal reflecting tile of a radio-frequency signal reflector having a plurality of signal reflecting tiles. The one or more receivers can include a testing circuit to process the set of modulated signal segments and determine a spatial intensity distribution of the radio-frequency signal upon the radio-frequency signal reflector.

Other embodiments and aspects of the disclosure will become apparent from the following description taken in conjunction with the following drawings.

BRIEF DESCRIPTION OF THE FIGURES

Many aspects of the invention can be better understood by referring to the following description in conjunction with the accompanying claims and figures. Like numerals indicate like structural elements and features in the various figures. For clarity, not every element may be labeled with numerals in every figure. The drawings are not necessarily drawn to scale; emphasis instead being placed upon illustrating the principles of the invention. The drawings should not be interpreted as limiting the scope of the invention to the example embodiments shown herein.

DETAILED DESCRIPTION

Throughout this description, embodiments and variations are described for the purpose of illustrating uses and implementations of inventive concepts. The illustrative description should be understood as presenting examples of inventive concepts, rather than as limiting the scope of the concepts as disclosed herein. Towards this end, certain words and terms are used herein solely for convenience and such words and terms should be broadly understood as encompassing various objects and actions that are generally understood in various forms and equivalencies by persons of ordinary skill in the art. Furthermore, the word "example" as used herein is intended to be non-exclusionary and non-limiting in nature. More particularly, the word "exemplary" as used herein indicates one among several examples and it should be understood that no special emphasis, exclusivity, or preference, is associated or implied by the use of this word. It must also be understood that the various elements shown in the various figures are directed primarily at describing certain aspects of the disclosure in a conceptual manner. Consequently, the methods, features, elements, and processes disclosed herein can be implemented using various kinds of hardware, software, and/or firmware in accordance with the disclosure.

Generally, in accordance with one illustrative embodiment, an RF device can include a receiver and an antenna. The antenna of the RF device is configured to receive from an RF signal reflector, a reflected RF signal containing a set of modulated signal segments. Each modulated signal segment has a unique modulation pattern that is present in the modulated signal segment as a result of the RF reflector using a set of modulation code sequences to modulate a reflective property of each of a number of signal reflecting tiles in a uniquely identifiable time-variant pattern.

The unique modulation pattern present in each of the modulated signal segments received from the RF signal reflector can be used by a testing circuit in the receiver to identify a set of signal reflecting tiles and based upon the identification, to determine a spatial intensity distribution of the RF signal when incident upon the RF signal reflector. The spatial intensity distribution can then be used by the testing circuit to determine a spatial radiation characteristic of an RF signal that is transmitted by a transmitter for purposes of producing the reflected radio-frequency signal. The transmitter, which can be incorporated into the RF device, includes a beam steering circuit that can be used to modify a radiation pattern of the transmitted RF signal to address a misalignment for example. These aspects, as well as other aspects in accordance with the disclosure will be described below in further detail.

Figure 1:
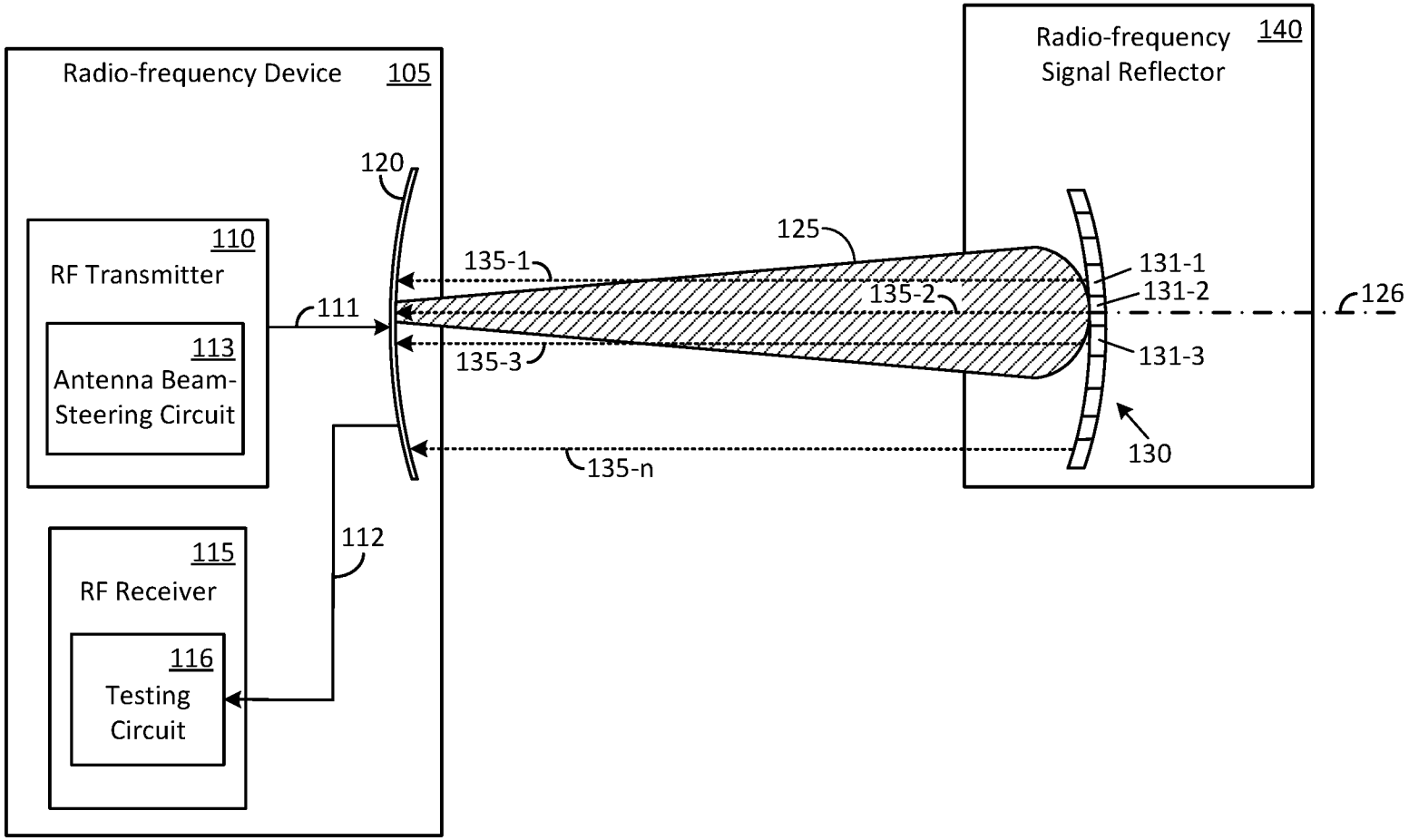
FIG. 1 shows an exemplary RF device configured to transmit an RF signal with a desired radiation characteristic towards an RF signal reflector.

FIG. 1 shows an exemplary RF device 105 configured to transmit an RF signal 125 with a desired radiation characteristic towards an RF signal reflector 140. The RF device 105 includes an RF transmitter 110 that is coupled to an antenna 120, and further includes an RF receiver 115 that is also coupled to the antenna 120. Thus, in this example implementation, the RF device 105 can be used as a transceiver for transmitting, as well as receiving, RF signals. However, in another example implementation, wherein the RF device 105 is configured exclusively as a transmitter, the RF receiver 115 can be omitted and incorporated into a different RF device if so desired. When implemented in this manner, an RF signal can be transmitted by the RF transmitter 110 located in the RF device 105 and a reflected portion of the RF signal can be received in a receiver located in a different device (not shown). In yet another example implementation, the RF device 105 can incorporate multiple RF transmitters and/or multiple RF receivers and/or multiple antennas, interconnected to each other in various configurations using various types of electronic and/or mechanical elements. One example of such a configuration is described below in the form of an adaptation of a rake receiver. Furthermore, in various implementations, the RF device 105 can be embodied in various compact packages such as in an integrated circuit (IC), an application specific integrated circuit (ASIC), a field programmable gate array (FPGA), or a hybrid microcircuit.

Drawing attention now to the RF device 105 shown in FIG. 1, when configured in a transmit mode of operation, the RF transmitter 110 provides an RF signal to the antenna 120 via a transmit link 111. The RF signal is radiated out of the antenna 120 in a radiation pattern that is configurable by an antenna beam-steering circuit 113, which can be incorporated into the RF transmitter 110 or can be located elsewhere in the RF device 105. The antenna beam-steering circuit 113 can include one or more phase delay elements that are used to selectively change various radiation pattern characteristics of the RF signal 125. In this example embodiment, the RF signal 125 can be a millimeter-wave signal having one or more lobes. Of these one or more lobes, a main lobe that is shown in FIG. 1 can have a narrow beam characteristic with a configurable directivity. The directivity of the main lobe, as well as other lobes when present, can be configured via the antenna beam-steering circuit 113. In various embodiments, the RF signal 125 can be a continuous-wave signal, a signal modulated by a pilot tone, and/or a signal having certain types of predefined modulation formats.

In the exemplary illustration shown in FIG. 1, the main lobe of the RF signal 125 is optimally aligned with respect to the RF signal reflector 140. The optimal alignment can be understood in view of the orientation of the main lobe of the RF signal 125 coinciding with a line-of-sight axis 126 that extends from the antenna 120 to an array of signal reflecting tiles 130 that is a part of the RF signal reflector 140. As a result of the optimal alignment, a central group of signal reflecting tiles 131-1, 131-2, and 131-3 (among "n" number of tiles that constitute the array of signal reflecting tiles 130) is exposed to the main lobe of the RF signal 125.

Each of the "n" signal reflecting tiles of the array of signal reflecting tiles 130 is individually controllable in the RF signal reflector 140 so as to impose a time-variant reflective characteristic upon respective portions of the RF signal 125. Consequently, the main lobe of the RF signal 125 is reflected back towards the antenna 120 in the form of a reflected RF signal containing a set of modulated signal segments.

More particularly, a first portion of the main lobe is reflected back towards the antenna 120 by the signal reflecting tile 131-1 and is indicated by a modulated signal segment 135-1. Similarly, a second portion of the main lobe is reflected back towards the antenna 120 by the signal reflecting tile 131-2 and is indicated by a modulated signal segment 135-2. A third portion of the main lobe is reflected back towards the antenna 120 by the signal reflecting tile 131-3 and is indicated by a modulated signal segment 135-3. Effectively, in various exemplary applications, "n" such modulated signal segments ($n \geq 2$) can be present after the main lobe and/or other lobes of the RF signal 125 are reflected by a corresponding "n" signal reflecting tiles of the array of signal reflecting tiles 130. Each modulated signal segment incorporates a unique modulation pattern that is indicative of a time-variant reflectivity characteristic of each of the "n" signal reflecting tiles of the RF signal reflector 140. Furthermore, in another exemplary application, a single modulated signal segment ($n=1$) can be present after the main lobe and/or another lobe of the RF signal 125 is reflected by a single signal reflecting tile of the RF signal reflector 140. The modulated signal segment can be used to identify the single signal reflecting tile in the array of signal reflecting tiles 130.

The antenna 120 of the RF device 105 receives the set of modulated signal segments (135-1, 131-2, and 131-3, in this example) and routes these modulated signal segments, via a receive link 112, to a testing circuit 116. As described below in further detail, the modulated signal segments can be processed by the testing circuit 116 in order to determine a spatial intensity distribution of the RF signal 125 upon the RF signal reflector 140. The testing circuit 116 can be a part of the RF receiver 115 or can be located elsewhere in the RF device 105. The testing circuit can also be implemented in the form of an external test unit that is coupled to the RF device 105.

Operationally, the testing circuit 116 uses the time-variant reflectivity characteristic present in each of the received set of modulated signal segments to identify a corresponding signal reflecting tile among the "n" signal reflecting tiles of the array of signal reflecting tiles 130. In the example configuration shown in FIG. 1, the testing circuit 116 detects a first unique time-variant reflectivity characteristic that is present in the modulated signal segment 135-1 as a result of reflection by the signal reflecting tile 131-1; a second unique time-variant reflectivity characteristic that is present in the modulated signal segment 135-2 as a result of reflection by the signal reflecting tile 131-2; and a third unique time-variant reflectivity characteristic that is present in the modulated signal segment 135-3 as a result of reflection by the signal reflecting tile 131-3. The testing circuit 116 can further determine a signal intensity level in each of the modulated signal segments 135-1, 131-2, and 131-3. The intensity levels can be determined in relative form (for example, modulated signal segment 135-1 as having 10% of a reference signal intensity, modulated signal segment 135-2 as having an 80% of the reference signal intensity, and modulated signal segment 135-3 as having a 10% of the reference signal intensity). Alternatively, if so desired, the intensity levels can be determined in absolute form (for example, modulated signal segment 135-1 having 10 dBm signal intensity, modulated signal segment 135-2 having 80 dBm signal intensity, and modulated signal segment 135-3 having 10 dBm signal intensity).

Based on determining the signal intensity level in each of the modulated signal segments 135-1, 131-2, and 131-3 and on identifying the signal reflecting tiles 131-1, 131-2, and 131-3 as having provided the modulated signal segments 135-1, 131-2, and 131-3, the testing circuit 116 can characterize the spatial intensity distribution of the RF signal 125 upon the RF signal reflector 140 in different ways. For example, in the numerical example provided above, the spatial intensity distribution of the RF signal 125 can be characterized by a ratio 1:8:1 that can be associated with a portion of the RF signal reflector 140 in which the signal reflecting tiles 131-1, 131-2, and 131-3 are located.

Thus, with prior knowledge of the layout of the "n" signal reflecting tiles of the RF signal reflector 140, the testing circuit 116 can determine a spatial radiation characteristic of the RF signal 125. Specifically, in this example, the testing circuit 116 can make a determination that the RF signal 125 has a spatial radiation characteristic that is optimally oriented along the line-of-sight axis 126 with respect to the RF reflector 140. The testing circuit 116 can characterize the spatial radiation characteristic of the RF signal 125 in several different ways, including for example, in terms of a directivity of a main lobe and/or in terms of one or more side lobes.

In the context of side lobes, it may be pertinent to point out that though the description above alludes to a main lobe that is incident upon the RF signal reflector 140, one or more side lobes of the RF signal 125 can also be incident upon the RF signal reflector 140. The testing circuit 116 can accordingly process other modulated signal segments in addition to, or in lieu of, the modulated signal segments 135-1, 131-2, and 131-3 to identify and characterize one or more side lobes of the RF signal 125.

In various exemplary applications, the spatial intensity distribution of the RF signal 125 upon the RF reflector 140 (as determined by the testing circuit 116) can be used for performing different operations. For example, the spatial intensity distribution of the RF signal 125 can be used by the testing circuit 116 (in cooperation with the antenna beam-steering circuit 113) to modify a spatial radiation characteristic of the RF signal 125 at the RF device 105 in order to remedy a main lobe misalignment. In another example, the spatial intensity distribution of the RF signal 125 can be used to configure the RF signal reflector 140 to reflect the incident RF signal 125 in a desired direction. This action can be carried out by using an antenna beam steering circuit (not shown) that includes one or more phase delay elements for selectively changing the radiation pattern characteristics of one or more signal reflecting tiles of the RF signal reflector 140. Accordingly, if so desired, the RF signal reflector 140 can be configured to not only reflect the incident RF signal 125 towards the RF device 105 but towards other devices, such as a second RF device (not shown) and/or a third RF device (not shown), without modifying the spatial radiation characteristic of the RF signal 125 at the RF device 105. One or both of the second RF device and the third RF device can include an RF receiver, for example, to receive the RF signal 125 transmitted by the RF device 105 (which may lack an RF receiver) after reflection by the RF reflector 140.

When the testing circuit 116 is incorporated into the RF device 105 (inside an IC package, for example), the RF device 105 can execute an automated self-test procedure for testing various operational aspects of the RF device 105. In this manner, the automated self-test procedure can be executed in each of a number of ICs that are batch-manufactured. The automated self-test procedure can be used for example, to detect a misalignment of a main lobe of the RF beam 125 in one or more ICs due to manufacturing tolerances and/or defects. Upon detecting a misalignment of the RF beam 125 in any IC, the testing circuit 116 can be used to automatically configure the antenna beam-steering circuit 113 in that IC for rectifying the misalignment.

The testing circuit 116 can also be used to provide one or more trigger signals to other circuits (not shown) that are coupled to the RF transmitter 110 and used for configuring the RF transmitter 110 to transmit the RF signal 125 with a desired antenna radiation pattern and in a desired direction. The one or more trigger signals can be provided by the testing circuit 116 to these other circuits as a part of the automated self-test procedure or as a part of a calibration procedure to calibrate and/or measure various parameters of the RF device 105, including the spatial radiation characteristics of the RF signal 125.

As can be understood, incorporating the testing circuit 116 into the RF device 105 addresses various shortcomings in traditional test systems and methods, including the elimination of some traditional test-related equipment (RF receivers, RF signal analyzers, power supplies etc.), reducing test time, reducing test personnel, and reducing/eliminating various test-related overheads.

It will be pertinent to point out that in various exemplary embodiments in accordance with the disclosure, the RF signal reflector 140 is preferably located in a far-field region of the main lobe of the RF signal 125. The far-field region can be defined in several different ways, such as, a region that is located at least 10 wavelengths (10λ) away from the antenna 120. Thus, for example, when the RF signal 125 is operated at 62 GHz, the far-field region can be defined as a distance greater than 10×0.48354 centimeters from the antenna 120.

Figure 2:
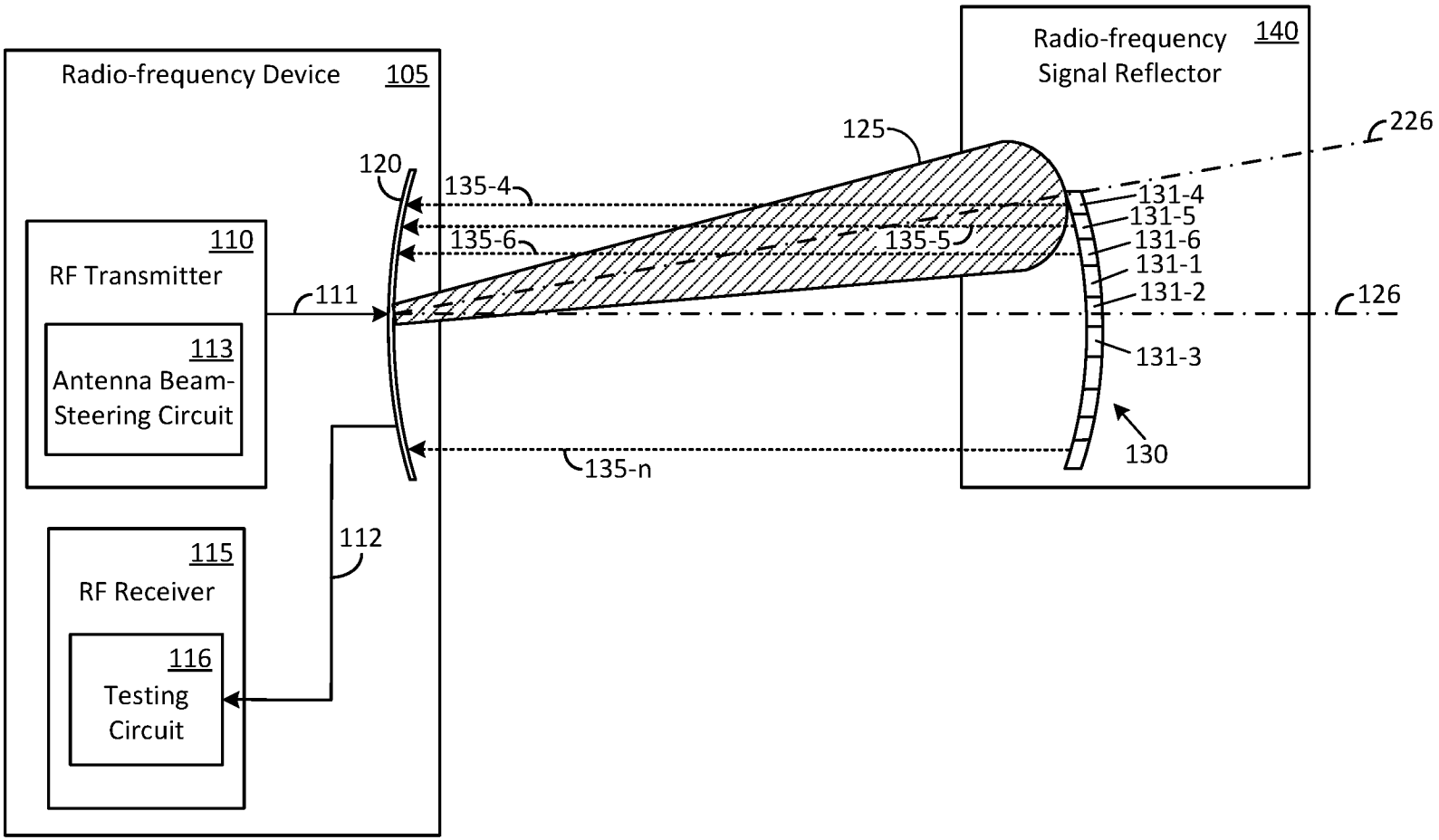
FIG. 2 shows the exemplary RF device of FIG. 1 when transmitting an RF signal having a misalignment of the main lobe with respect to the RF signal reflector.

Attention is now drawn to FIG. 2, which shows the RF device 105 operating with a misalignment of the main lobe of the RF signal 125 with respect to the RF signal reflector 140. The misalignment, which can be present due to various factors, such as a manufacturing tolerance, a component defect, or due to an improper phase-delay setting in the antenna beam-steering circuit 113, is manifested by an angular offset in a signal propagation axis 226 of the main lobe of the RF signal 125 with respect to the line-of-sight axis 126. It should be understood that solely for convenience of description, the RF signal 125 shown in FIG. 1 is described herein as being "optimally aligned" with respect to the RF signal reflector 140, and the RF signal 125 shown in FIG. 2 as being "misaligned" with respect to the RF signal reflector 140. In an alternative embodiment, an RF signal that is not aligned with the line-of-sight axis 126 (such as the RF signal 125 shown in FIG. 2) can constitute an optimally aligned RF signal.

Referring once again to FIG. 2, due to the misalignment, the main lobe of the RF signal 125 is predominantly incident upon a set of signal reflecting tiles 131-4, 131-5, and 131-6 that are offset (and different) than the central group of signal reflecting tiles 131-1, 131-2, and 131-3 of the RF signal reflector 140. Accordingly, each of the modulated signal segments 135-4, 131-5, and 131-6 that is reflected back towards the RF device 105 now incorporates a time-variant reflectivity characteristic bestowed by a respective one of the set of signal reflecting tiles 131-4, 131-5, and 131-6 rather than by the signal reflecting tiles 131-1, 131-2, and 131-3 (as shown in FIG. 1).

In this second example configuration, the testing circuit 116 detects a first unique time-variant reflectivity characteristic that is present in the modulated signal segment 135-4 as a result of reflection by the signal reflecting tile 131-4; a second unique time-variant reflectivity characteristic that is present in the modulated signal segment 135-5 as a result of reflection by the signal reflecting tile 131-5; and a third unique time-variant reflectivity characteristic that is present in the modulated signal segment 135-6 as a result of reflection by the signal reflecting tile 131-6. The testing circuit 116 can further determine a signal intensity level of each of the modulated signal segments 135-4, 131-5, and 131-6 in the manner described above with respect to FIG. 1. These signal intensity levels correspond to a portion of the main lobe of the RF signal 125 that is incident upon the set of signal reflecting tiles 131-4, 131-5, and 131-6. It can be understood that the intensity levels of the RF signal 125 incident upon the set of signal reflecting tiles 131-1, 131-2, and 131-3 (described above with respect to FIG. 1) is negligible in comparison to the intensity levels of the RF signal 125 incident upon the set of signal reflecting tiles 131-3, 131-4, and 131-5.

Based on identifying the signal reflecting tiles 131-3, 131-4, and 131-5 as having provided the modulated signal segments 135-4, 131-5, and 131-6 in the example shown in FIG. 2, the testing circuit 116 can make a determination that the RF signal 125 has a spatial radiation characteristic that is misaligned with respect to the RF reflector 140. The extent of the misalignment can be determined by the testing circuit 116 based on the signal intensity level in each of the modulated signal segments 135-4, 131-5, and 131-6.

The intensity levels can be determined in a relative form (for example, modulated signal segment 135-4 as having 70% of a reference signal intensity, modulated signal segment 135-5 as having an 20% of the reference signal intensity, and modulated signal segment 135-6 as having a 10% of the reference signal intensity). Alternatively, if so desired, the intensity levels can be determined in absolute form (for example, modulated signal segment 135-4 having 70 dBm signal intensity, modulated signal segment 135-5 having 20 dBm signal intensity, and modulated signal segment 135-6 having 10 dBm signal intensity).

Furthermore, based on identifying the signal reflecting tiles 131-4, 131-5, and 131-6 as having provided the modulated signal segments 135-4, 131-5, and 131-6 in this exemplary configuration, the testing circuit 116 can characterize the spatial intensity distribution of the RF signal 125 upon the RF signal reflector 140 in different ways. In the numerical example provided above, the spatial intensity distribution of the RF signal 125 can be characterized for example, by a ratio 7:2:1 that can be associated with a portion of the RF signal reflector 140 in which the signal reflecting tiles 131-4, 131-5, and 131-6 are located. Thus, with prior knowledge of the layout of the "n" signal reflecting tiles of the RF signal reflector 140, the testing circuit 116 can determine, in this example, that the signal reflecting tiles 131-4, 131-5, and 131-6 are not centrally located in the RF signal reflector 140 and that the spatial radiation characteristic of the RF signal 125 has a misalignment with respect to the RF signal reflector 140. The testing circuit 116 can also determine a nature of the misalignment based for example, on the descending order in the ratio 7:2:1, which indicates that a portion of the RF signal 125 is extending upwards beyond a periphery of the RF signal reflector 140.

Though shown in FIG. 2 in a two-dimensional (2D) format, it should be understood that in practice, the RF signal reflector 140 has a multi-dimensional format, and the testing circuit 116 can determine the spatial intensity distribution and the spatial radiation characteristics in various directions and in various formats, including in azimuth-related formats. Specifically, in one example implementation, the RF signal reflector 140 has a hemispherical structure that can be used as a dome to partially, or fully, cover the RF device 105 shown in FIG. 1. The inner surface of the hemispherical structure houses the array of signal reflecting tiles 130, thereby ensuring that the RF signal 125 will be reflected back to the RF device 105 irrespective of any misalignment in the directivity of the main lobe, for example. In another example implementation, the RF signal reflector 140 has an alterable geometry and/or orientation, each of which can be altered manually and/or electronically.

Upon determining the misalignment of the RF signal 125, the testing circuit 116 can cooperate with the antenna beam-steering circuit 113 to reconfigure the RF transmitter 110 and address the misalignment. The reconfiguration can be carried out for example, in order to replace the misaligned RF signal 125 with another RF signal having a rectified radiation characteristic and/or to realign the misaligned RF signal 125. In one example implementation, reconfiguring the antenna beam-steering circuit 113 may further involve replacing, or tweaking one or more phase delay elements in the antenna beam-steering circuit 113. The tweaking can be carried out automatically by the testing circuit 116 or manually by a technician, for example.

Figure 3:
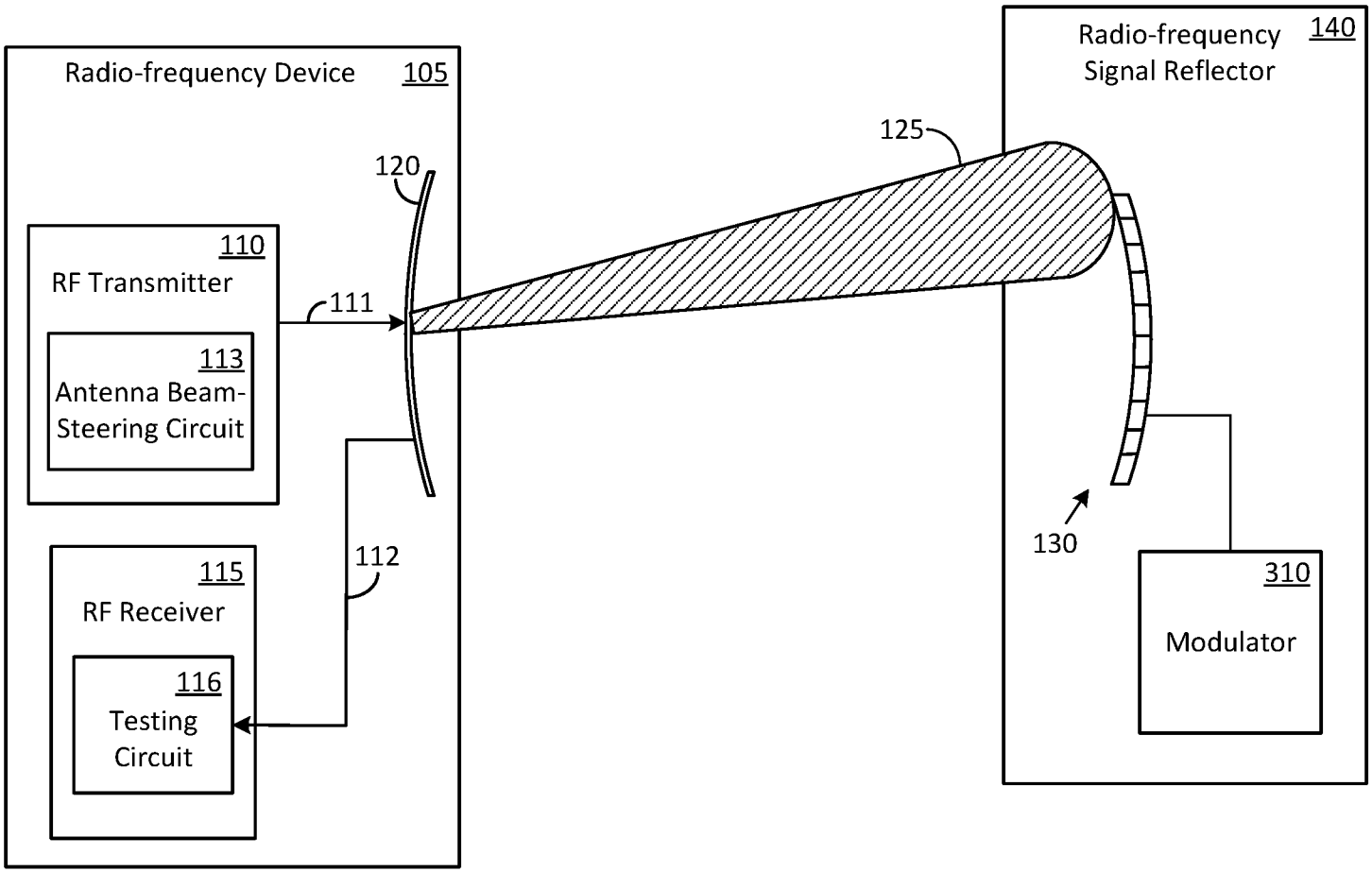
FIG. 3 shows an exemplary modulator that can be incorporated into an RF signal reflector, in accordance with the disclosure.

FIG. 3 shows an exemplary modulator 310 that can be incorporated into the RF signal reflector 140 for configuring each of the signal reflecting tiles of the array of signal reflecting tiles 130 to provide the time-variant reflective characteristic in accordance with the disclosure.

Figure 4:
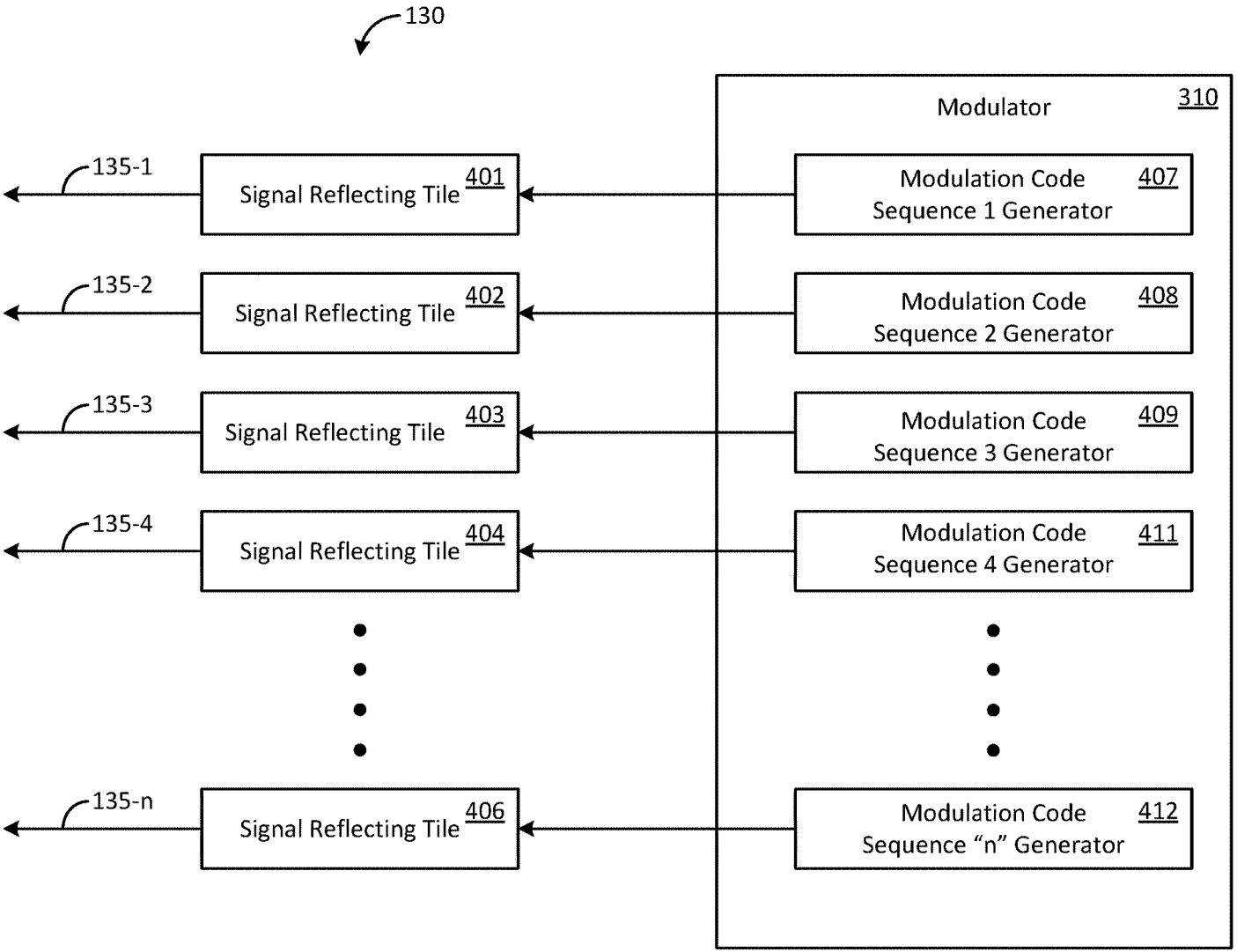
FIG. 4 shows an example implementation of the modulator shown in FIG. 3.

FIG. 4 shows one example embodiment of the modulator 310. In this exemplary embodiment, the modulator 310 includes "n" modulation code sequence generators. Specifically, modulation code sequence 1 generator 407 generates a first modulation code sequence that is provided to a first signal reflecting tile 401, and the remaining "n−1" modulation code sequence generators of the "n" modulation code generators are similarly configured to provide unique modulation code sequences to each of a respective one of the remaining "n−1" signal reflecting tiles. Thus, modulation code sequence 2 generator 408 generates a second modulation code sequence that is provided to a second signal reflecting tile 402. Modulation code sequence 3 generator 409 generates a third modulation code sequence that is provided to a third signal reflecting tile 403. Modulation code sequence 4 generator 411 generates a fourth modulation code sequence that is provided to a fourth signal reflecting tile 404. Modulation code sequence "n" generator 412 generates a "$n^{th}$" modulation code sequence that is provided to a "$n^{th}$" signal reflecting tile 406.

The "n" modulation code sequences can incorporate various types of code formats as long as each modulation code sequence is uniquely distinguishable and allows the testing circuit 116 to unambiguously identify each of the "n" signal reflecting tiles that are reflecting the RF signal 125 back to the antenna 120. Towards this end, the types of code formats and/or modulation code sequences can be selected on the basis of allowing the testing circuit 115 to execute correlation procedures in a bounded manner and/or other pattern identification procedures that are directed at unambiguously identifying each of the "n" signal reflecting tiles reflecting the RF signal 125 back to the antenna 120.

Consequently, in a first exemplary implementation, the modulation code sequence 1 generator 407 is a pseudo-random signal generator that generates a first pseudo-random code sequence, while the modulation code sequence 2 generator 408 is another pseudo-random signal generator that generates a second pseudo-random code sequence that is distinguishably different than the first pseudo-random code sequence. Each of the other modulation code sequence generators are also pseudo-random signal generators, each generating a uniquely distinguishable pseudo-random code sequence.

In another exemplary implementation, the modulation code sequence 1 generator 407 is a Gold-code signal generator that generates a first Gold code sequence, while the modulation code sequence 2 generator 408 is another Gold code signal generator that generates a second Gold code sequence that is distinguishably different than the first Gold code sequence. Each of the other modulation code sequence generators are also Gold code signal generators, each generating a different Gold code sequence. The Gold code sequences can be chosen such that the cross-correlation between each of the codes in use is bounded and minimized so as to enhance the ability of the testing circuit 116 to uniquely distinguish each of the codes in use.

Irrespective of the type of code format used, each of the "n" modulation code sequences generated by the modulator 310 is used to modulate a reflectivity characteristic of a respective signal reflecting tile in the array of reflecting tiles 130, in a time-variant pattern. For example, with reference to the signal reflecting tile 401, the first modulation code sequence provided by the code sequence 1 generator 407, can be used to place the signal reflecting tile 401 for a first period of time in a condition whereby any RF signal incident upon the signal reflecting tile 401 is reflected back towards the RF device 105 without any change in phase. The first period of time can correspond to a periodicity of one bit of the first modulation code sequence (for example, the periodicity of a bit in a logic high state). The first modulation code sequence can be further used to place the signal reflecting tile 401 for a second period of time in a condition whereby any RF signal incident upon the signal reflecting tile 401 is reflected back towards the RF device 105 with a change in signal phase. For example, during the second period of time, the incident RF signal can be reflected back towards the RF device 105 with a 180° phase shift. The second period of time can correspond to a periodicity of another bit of the first modulation code sequence (for example, the periodicity of a bit in a logic low state). Thus, the reflectivity of the signal reflecting tile 401 can be modulated to provide a time-variant reflective characteristic that corresponds to the first modulation code sequence.

In other words, the first time-variant pattern corresponding to the first modulation code sequence is selected to ensure that the signal reflecting tile 401 is placed in a uniquely distinguishable state with respect to each of the remaining (n−1) signal reflecting tiles, and the second time-variant pattern corresponding to the second modulation code sequence is selected to ensure that the signal reflecting tile 402 is placed in another uniquely distinguishable state with respect to each of the remaining (n−1) plurality of signal reflecting tiles.

It may be pertinent to point out that in some exemplary embodiments, the RF signal 125 can incorporate one of several modulation formats prior to being modulated and reflected by a respective signal reflecting tile. The configuring of the various signal reflecting tiles in the array of signal reflecting tiles 130 to provide the time-variant reflective characteristics can be viewed as a complementary operation that does not adversely affect the use of these modulation formats in various applications in accordance with the disclosure. However, in one exemplary mode of operation of the testing circuit 116 (shown in FIG. 1), the RF signal 125 is transmitted as a continuous-wave (CW) signal so as to maximize a signal-to-noise ratio during testing, thereby obtaining a greater level of discrimination between the various modulated signal segments that helps in the identification of one or more signal reflecting tiles.

Referring back to FIGS. 1 and 2, some or all of the modulated signal segments 135-1 through **135-*n* that are shown in FIG. 4, are propagated to the antenna 120 for processing by the testing circuit 116. When the RF receiver 115 includes multiple receivers that are configured for example, in the form of an adaptation of a rake receiver, each finger of the adapted rake receiver can be used to receive a respective one of the modulated signal segments 135-1 through 135-*n*, and to route the modulated signal segments 135-1 through 135-*n* to the testing circuit 116. Furthermore, the testing circuit 116 can be implemented using multiple circuit elements in a distributed manner with various similar or non-similar portions of the testing circuit 116** coupled to, or incorporated into, each of the fingers of the adapted rake receiver.

Irrespective of the manner in which the RF receiver 115 and/or the testing circuit 116 is implemented, a correlation circuit (not shown) is used for processing each of the modulated signal segments 135-1 through **135-*n* in order to identify each modulation code sequence when present, and therefrom, identify a corresponding signal reflecting tile. Towards this end, the RF receiver 115 and/or the testing circuit 116 can include elements such as a processor, a memory, and demodulator. The demodulator (not shown) when located in the RF receiver 115 and/or the testing circuit 116 can include a set of modulation code sequence generators that replicate the "n" modulation code sequence generators in the modulator 310 of the RF signal reflector 140. During execution of the correlation procedure, a first modulation code sequence that matches the first time-variant pattern present in the modulated signal segment 135-1 is used by the demodulator to detect a presence of the first time-variant pattern in the set of modulated signal segments received in the RF receiver 115. A match if detected, indicates that the first signal reflecting tile 401 of the array of signal reflecting tiles 130 is reflecting back to the antenna 120, a portion of the main lobe of the RF signal 125 that is transmitted towards the RF signal reflector 140. In one example implementation, an amplitude of the reflected signal received from the first signal reflecting tile 401 can be determined by the testing circuit 116 and used as one parameter to characterize the spatial intensity distribution of the RF signal reflector 140**.

Similarly, a match between a second modulation code sequence and a second time-variant pattern used in the modulated signal segment 135-2 is indicative of the second signal reflecting tile 402 of the array of signal reflecting tiles 130 reflecting another portion of the main lobe of the RF signal 125 directed towards the RF signal reflector 140. An amplitude of the RF signal reflected by the second signal reflecting tile 402 can be determined and used in conjunction with the amplitude of the RF signal reflected by the first signal reflecting tile 401 to further characterize the spatial intensity distribution of the RF signal reflector 140.

On the other hand, if no match is detected when using a particular modulation code sequence, the lack of a match is indicative that a corresponding signal reflecting tile associated with this particular modulation code is not reflecting any portion of the main lobe of the RF signal 125.

The result of the correlation procedure executed by the correlation circuit allows the testing circuit 116 to determine the spatial intensity distribution of the RF signal 125 when incident upon the RF signal reflector 140 and one or more spatial radiation characteristics of the RF signal 125. The spatial radiation characteristics of the RF signal 125 transmitted by the antenna 120 can be characterized for example, by signal levels radiated in various directions and/or by signal levels present at various locations along the main lobe. Such signal levels can be derived not only from reflected signal level data obtained via the testing circuit 116 but also by using extrapolation techniques and knowledge of the signal levels and radiation characteristics of the RF signal 125 at the antenna 120.

Figure 5:
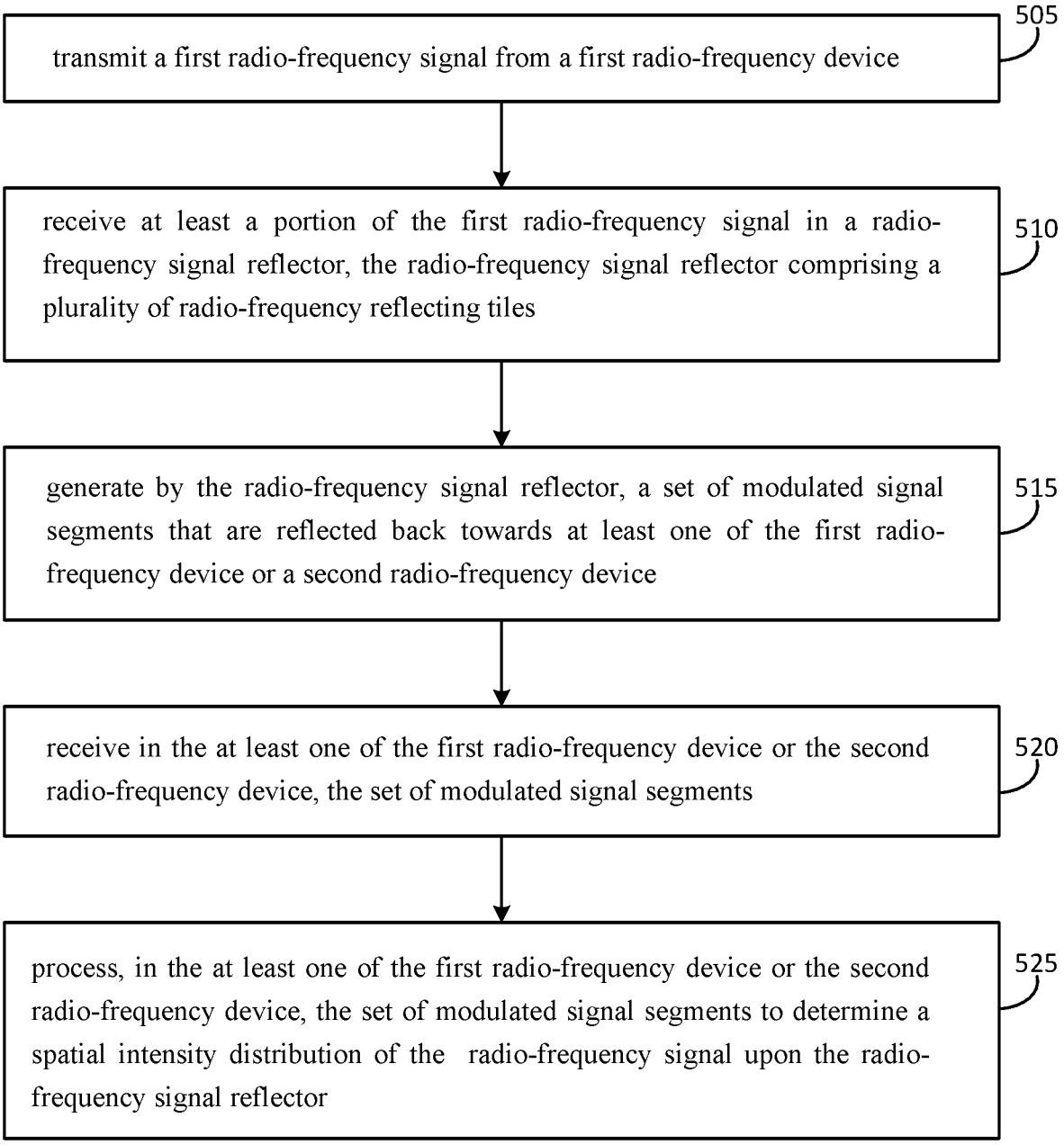
FIG. 5 shows a flowchart of a method of determining a spatial radiation characteristic of an RF signal transmitted by an RF device, in accordance with the disclosure.

FIG. 5 shows a flowchart of a method of determining a spatial radiation characteristic of the RF signal 125 transmitted by the RF device 105, in accordance with the disclosure. The method may be implemented in whole or in part by a processor that can be incorporated into the RF device 105. When using a processor, a memory can be included in the RF device 105 for storing executable software/firmware and/or executable code and other data associated with the methods and systems disclosed herein.

In block 505, the RF signal 125 is transmitted from the RF device 105. In block 510, at least a portion of the RF signal 125 is received in the RF signal reflector 140. The RF signal reflector 140 includes a number of signal reflecting tiles. In block 515, the RF signal reflector 140 generates a set of modulated signal segments that are reflected back towards the RF device 105 and/or another RF device. In block 520, the RF device 105 and/or the other RF device receive the set of modulated signal segments. In block 525, the RF device 105 and/or the other RF device process the set of modulated signal segments to determine a spatial intensity distribution of the RF signal 125 upon the RF signal reflector 140.

Figure 6:
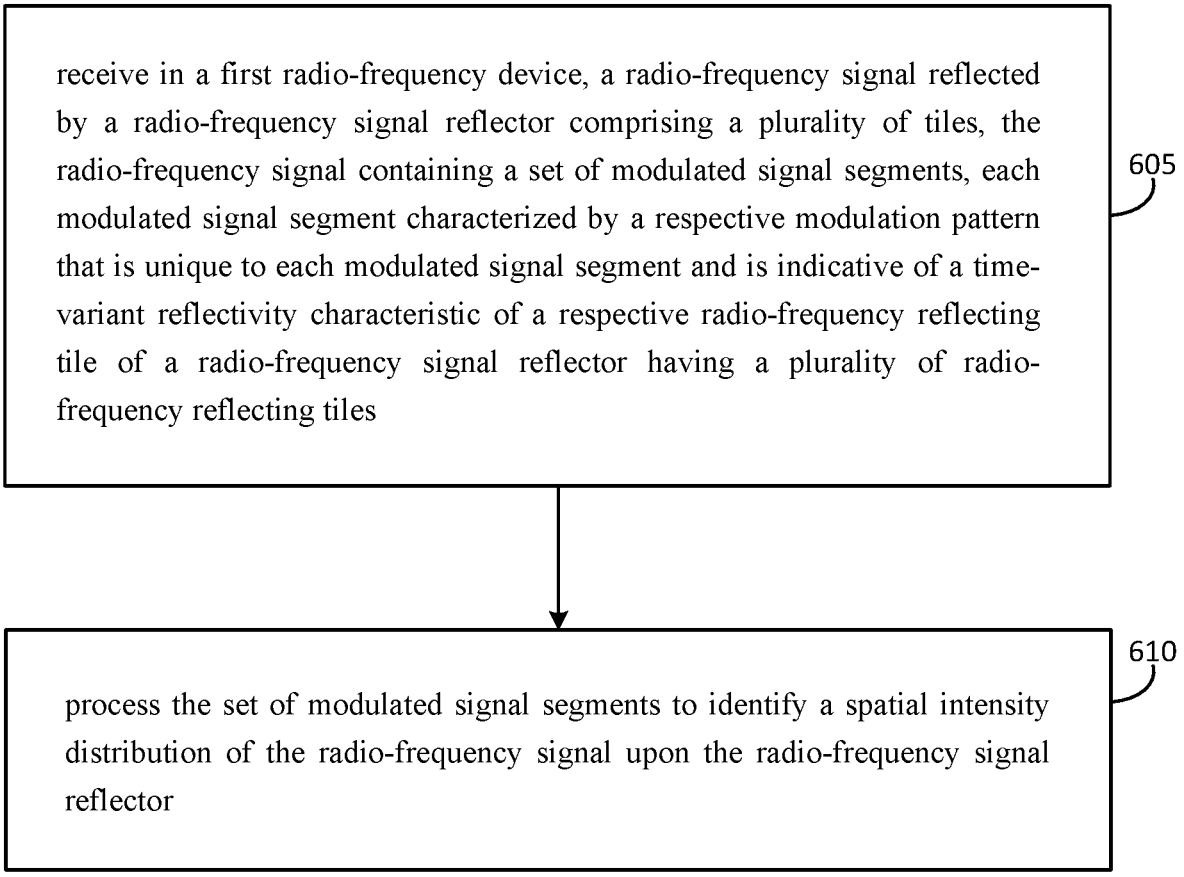
FIG. 6 shows a flowchart of a method of determining a spatial radiation characteristic of a transmitted RF signal by processing a set of modulated signal segments, in accordance with the disclosure.

FIG. 6 shows a flowchart of a method of determining a radiation characteristic of the transmitted RF signal 125 by processing a set of modulated signal segments, in accordance with the disclosure. In block 605, a reflected RF signal containing a set of modulated signal segments is received in the RF device 105. Each modulated signal segment is characterized by a respective modulation pattern that is unique to each modulated signal segment and is indicative of a time-variant reflectivity characteristic of a respective signal reflecting tile of the RF signal reflector 140. In block 610, the set of modulated signal segments is processed to identify a spatial intensity distribution of the RF signal 125 upon the RF signal reflector 140.

In summary, it should be noted that the invention has been described with reference to a few illustrative embodiments for the purpose of demonstrating the principles and concepts of the invention. It will be understood by persons of skill in the art, in view of the description provided herein, that the invention is not limited to these illustrative embodiments. Persons of skill in the art will understand that many such variations can be made to the illustrative embodiments without deviating from the scope of the invention.

What is claimed is:

1. A method comprising:

transmitting a first radio-frequency signal from a first radio-frequency device;

receiving at least a portion of the first radio-frequency signal in a radio-frequency signal reflector, the radio-frequency signal reflector comprising a plurality of signal reflecting tiles;

generating by the radio-frequency signal reflector, a set of modulated signal segments that are reflected back towards at least one of the first radio-frequency device or a second radio-frequency device, the generating comprising:

using a first modulation code sequence to modulate a reflectivity of a first signal reflecting tile in a first time-variant pattern and produce therefrom, a first modulated signal segment indicative of a first time-variant reflective characteristic; and using a second modulation code sequence to modulate a reflectivity of a second signal reflecting tile in a second time-variant pattern and produce therefrom, a second modulated signal segment indicative of a second time-variant reflective characteristic;

receiving in the first radio-frequency device or the second radio-frequency device, the set of modulated signal segments; and processing, in the first radio-frequency device or the second radio-frequency device, the set of modulated signal segments to determine a spatial intensity distribution of the first radio-frequency signal upon the radio-frequency signal reflector.

2. The method of claim 1, further comprising:

using the spatial intensity distribution to determine one or more spatial radiation characteristics of the first radio-frequency signal.

3. The method of claim 2, wherein the one or more spatial radiation characteristics are indicative of a misalignment of the first radio-frequency signal with respect to the radio-frequency signal reflector, the method further comprising:

modifying an antenna radiation pattern in the first radio-frequency device to address the misalignment.

4. The method of claim 2, wherein the one or more spatial radiation characteristics of the first radio-frequency signal comprises a first directivity of a main lobe of the first radio-frequency signal, and the method further comprises:

transmitting from the first radio-frequency device, a second radio-frequency signal having a main lobe with a second directivity that is based at least in part on the spatial intensity distribution of the first radio-frequency signal upon the radio-frequency signal reflector.

5. The method of claim 4, wherein the second directivity is selected as a part of at least one of a calibration procedure or a test procedure of the first radio-frequency device.

6. The method of claim 5, wherein the first radio-frequency device is configured to receive the set of modulated signal segments from the radio-frequency signal reflector, and wherein the test procedure is a self-test procedure executed in the first radio-frequency device.

7. The method of claim 1, wherein modulating the reflectivity of the first signal reflecting tile in the first time-variant pattern comprises the first signal reflecting tile being placed in a first uniquely distinguishable state with respect to all other signal reflecting tiles of the plurality of signal reflecting tiles, and wherein modulating the reflectivity of the second signal reflecting tile in the second time-variant pattern comprises the second signal reflecting tile being placed in a second uniquely distinguishable state with respect to all other signal reflecting tiles of the plurality of signal reflecting tiles.

8. The method of claim 7, wherein the first modulation code sequence is a first Gold code sequence and the second modulation code sequence is a second Gold code sequence that is different than the first Gold code sequence.

9. A method comprising:

receiving in a first radio-frequency device, a radio-frequency signal reflected by a radio-frequency signal reflector comprising a plurality of signal reflecting tiles, the radio-frequency signal containing a set of modulated signal segments, each modulated signal segment having a respective modulation pattern that is unique to each modulated signal segment and is indicative of a time-variant reflectivity characteristic of a respective signal reflecting tile of the radio-frequency signal reflector; and processing the set of modulated signal segments to identify a spatial intensity distribution of the radio-frequency signal upon the radio-frequency signal reflector, the processing comprising:

identifying a first signal amplitude of the radio-frequency signal by using a first code sequence to detect a correlation between the first code sequence and the set of modulated signal segments;

identifying a second signal amplitude of the radio-frequency signal by using a second code sequence to detect a correlation between the second code sequence and the set of modulated signal segments; and determining, based on at least one of the first signal amplitude or the second signal amplitude, the spatial intensity distribution of the radio-frequency signal upon the radio-frequency signal reflector.

10. The method of claim 9, further comprising:

determining, based at least in part on the spatial intensity distribution, one or more spatial radiation characteristics of a radio-frequency signal transmitted by one of the first radio-frequency device or a second radio-frequency device.

11. The method of claim 10, wherein the radio-frequency signal transmitted by the one of the first radio-frequency device or a second radio-frequency device is at least one of a continuous-wave signal, a signal modulated by a pilot tone, or a signal having a predefined modulation format.

12. The method of claim 10, further comprising:

modifying an antenna radiation pattern of the first radio-frequency device based on the spatial intensity distribution of the radio-frequency signal.

13. The method of claim 12, wherein modifying the antenna radiation pattern is a part of at least one of a calibration procedure or a test procedure of the first radio-frequency device.

14. The method of claim 9, wherein the first code sequence is a first Gold code sequence and the second code sequence is a second Gold code sequence that is different than the first Gold code sequence.

15. A radio-frequency device comprising:

a first antenna configured to receive a radio-frequency signal reflected by a radio-frequency signal reflector comprising a plurality of signal reflecting tiles, the radio-frequency signal containing a set of modulated signal segments, each modulated signal segment having a respective modulation code sequence modulation pattern that is unique to each modulated signal segment and is indicative of a time-variant reflectivity characteristic of a respective signal reflecting tile of the radio-frequency signal reflector; and at least a first receiver coupled to the first antenna, the first receiver comprising a testing circuit to process the set of modulated signal segments and determine a spatial intensity distribution of the radio-frequency signal when incident upon the radio-frequency signal reflector.

16. The radio-frequency device of claim 15, further comprising:

a transmitter coupled to the first antenna; and an antenna beam-steering circuit configured to provide a first directivity in a main lobe of a transmitted radio-frequency signal that is directed towards the radio-frequency signal reflector.

17. The radio-frequency device of claim 16, wherein the transmitted radio-frequency signal is a millimeter-wave radio-frequency signal, and wherein the antenna beam-steering circuit is operable to modify the first directivity based at least in part, on the spatial intensity distribution determined by the first receiver.

18. The radio-frequency device of claim 16, further comprising:

a second receiver coupled to a second antenna, the second receiver arranged to cooperate with the first receiver at least when the first receiver processes the set of modulated signal segments.

19. The radio-frequency device of claim 15, wherein the set of modulated signal segments is generated in the radio-frequency signal reflector by at least using a first modulation code sequence to modulate a reflectivity of a first signal reflecting tile in a first time-variant pattern and a second modulation code sequence to modulate a reflectivity of a second signal reflecting tile in a second time-variant pattern.

20. The radio-frequency device of claim 19, wherein modulating the reflectivity of the first signal reflecting tile in the first time-variant pattern comprises placing the first signal reflecting tile in a first uniquely distinguishable state with respect to all other signal reflecting tiles of the plurality of signal reflecting tiles, and wherein modulating the reflectivity of the second signal reflecting tile in the second time-variant pattern comprises placing the second signal reflecting tile in a second uniquely distinguishable state with respect to all other signal reflecting tiles of the plurality of signal reflecting tiles.

* * * * *